US005688443A

United States Patent [19]

Swanson

[11] Patent Number: 5,688,443

[45] Date of Patent: Nov. 18, 1997

[54] TEMPERATURE COMPENSATED FLUID FLOW METERING CARBURETOR AND METHOD

[75] Inventor: Mark S. Swanson, Cass City, Mich.

[73] Assignee: Walbro Corporation, Cass City, Mich.

[21] Appl. No.: 739,615

[22] Filed: Oct. 3, 1996

Related U.S. Application Data

[63] Continuation of Ser. No. 419,267, Apr. 10, 1995, abandoned.

[51] Int. Cl.[6] ..... F02M 1/10

[52] U.S. Cl. ..... 261/39.3; 261/39.5; 261/DIG. 8

[58] Field of Search ..... 261/39.5, 39.3, 261/DIG. 8

[56] References Cited

U.S. PATENT DOCUMENTS

| | | | |
|---|---|---|---|
| 1,103,802 | 7/1914 | Meissner . | |
| 1,194,769 | 8/1916 | Neagley . | |
| 1,413,212 | 4/1922 | Anderson | 261/39.5 |
| 1,619,612 | 3/1927 | Grudzinski | 261/39.5 |
| 1,922,266 | 8/1933 | Toman . | |
| 1,994,470 | 3/1935 | Grayson . | |
| 2,126,709 | 8/1938 | Alden . | |
| 2,156,128 | 4/1939 | Shaff . | |
| 2,225,261 | 12/1940 | Jorgensen | 261/39.5 |
| 2,297,231 | 9/1942 | Lichte . | |
| 2,310,594 | 2/1943 | Osburn et al. | 261/39.5 |
| 2,367,542 | 1/1945 | Udale . | |
| 2,460,647 | 2/1949 | Miller . | |
| 2,495,299 | 1/1950 | Tarter . | |
| 2,652,105 | 9/1953 | Tjomsland et al. . | |
| 2,675,792 | 4/1954 | Brown et al. | 261/39.5 |
| 2,820,473 | 1/1958 | Reiners . | |
| 2,830,621 | 4/1958 | Prescott . | |
| 3,095,175 | 6/1963 | Iketani . | |
| 3,378,063 | 4/1968 | Mefferd . | |
| 3,454,264 | 7/1969 | Sarto . | |
| 3,484,084 | 12/1969 | Simpson et al. . | |
| 3,587,553 | 6/1971 | Sutton | 261/39.5 |
| 3,696,997 | 10/1972 | Gifford . | |
| 3,719,322 | 3/1973 | Gifford . | |
| 3,758,084 | 9/1973 | Tuckey . | |
| 3,885,545 | 5/1975 | Charron et al. | 261/39.5 |
| 3,904,111 | 9/1975 | Petersson . | |
| 3,977,600 | 8/1976 | Sheets, Jr. . | |
| 4,001,354 | 1/1977 | Tuckey . | |
| 4,149,835 | 4/1979 | Wells . | |
| 4,184,465 | 1/1980 | Nakazeki et al. . | |
| 4,228,956 | 10/1980 | Varner . | |
| 4,360,481 | 11/1982 | Kaufman . | |
| 4,579,097 | 4/1986 | Yamamoto et al. . | |
| 4,759,883 | 7/1988 | Woody et al. . | |

FOREIGN PATENT DOCUMENTS

| | | |
|---|---|---|
| 473622 | 9/1946 | Japan . |
| 56-37421 | 8/1981 | Japan . |
| 56-115829 | 9/1981 | Japan . |
| 8649 | 12/1986 | U.S.S.R. . |

*Primary Examiner*—Tim R. Miles

*Attorney, Agent, or Firm*—Barnes, Kisselle, Raisch, Choate, Whittemore & Hulbert

[57] ABSTRACT

A temperature compensated carburetor including a composite valve member comprising a bi-metal strip and a gate valve needle for varying the effective flow cross-sectional area of the main and/or idle fuel supply duct to modulate the flow rate of fuel to the carburetor venturi mixing passage. The bi-metal strip generates substantially all of temperature-change-induced movement of the valve needle. The needle may be made of brass or aluminum, or alternatively of plastic material having a much greater coefficient of expansion than the aluminum carburetor body in which it is adjustable mounted such that differential linear expansion and contraction of the valve needle itself, as well as that of the bi-metal, relative to the carburetor body in response to ambient temperature changes varies the flow-controlling cross-sectional area of the fuel duct inversely relative to ambient temperature changes. A needle cylindrical mounting portion at one end is threadably secured in the strip movable free end. A reduced diameter needle body extension extends axially away from the needle mounting end and has cylindrical stem portion slidable in another bore of the carburetor body. The composite valve member is unrestrained in the direction of its movement from the needle free end to the strip fixed end fastened to the carburetor body. The needle free end is thus movable in a fuel feeding control passageway of the fuel duct to thus vary the flow controlling cross-section thereof.

35 Claims, 3 Drawing Sheets

TEMPERATURE COMPENSATED FLUID FLOW METERING CARBURETOR AND METHOD

This application is a continuation of application Ser. No. 08/419,267 filed on Apr. 10, 1995, now abandoned.

FIELD OF THE INVENTION

The present invention relates to fuel metering for engines using carburetors, and more particularly to a small diaphragm-type or float-bowl type carburetor for small internal combustion engines of the type used in portable tools such as chain saws, weed whips, snow blowers, lawn mowers and other power lawn and garden equipment, as well as in small off-road sport vehicles, etc.

BACKGROUND OF THE INVENTION

It has been a problem with carburetors since they were first used to maintain the air to fuel ratio (A/F) delivered from the carburetor to the engine as constant as possible under wide variations in load and engine RPM when the engines are to be employed in outdoor environments where ambient temperatures may range from −40° C. up to 50° C. Typically with uncompensated prior art small engine carburetors, when ambient temperature increases or decreases, the A/F changes. This ratio change is due to the change in air density and the change in fuel density and viscosity with temperature change. This A/F change is such that with an ambient temperature decrease, the A/F increases, i.e., becomes lean. The amount lean depends on idle or wide open throttle operating conditions, and whether the fuel flow through the fuel jet or nozzle (metering orifice) is laminar or turbulent. With increasing ambient temperature, the A/F decreases, i.e., the mixture comes rich.

It has thus been long recognized that it would be beneficial to have some means for compensating for temperature dependent A/F changes in order to better maintain a constant A/F regardless of ambient temperature conditions, even under substantially constant altitude operating conditions. Indeed, the prior art is replete with devices developed for carburetors and fuel injection systems which vary the mixture ratio in response to ambient temperature conditions to maintain a constant A/F. However, complexity, cost, bulk and reliability of such systems makes them impractical for use in the field of small single or dual cylinder engines such as used on chain saws, lawn mowers and other small engine-powered portable or mobile applications. In addition, small carburetors of this type have been decreasing in size because of the demands for smaller units to fit within small hand-held chain saws and weed whips. There has also been pressure on the manufacturers of carburetors to reduce the cost of these carburetors because of the keen competition in the field. It is also desirable that servicing of the carburetors be accomplished in as expedient a manner as possible and that the number of parts in the carburetors be reduced. These factors further mitigate against use of such known prior art solutions.

Accordingly, inexpensive mechanical carburetors still remain the only practical choice for gasoline fuel feeding to such small engines wherein the fuel flow to the fuel supply opening in the carburetor throat is controlled by a needle valve. Typically such carburetors are provided with a main adjustment orifice to control fuel supply to the main fuel nozzle, and an idle adjustment orifice and associated needle valve to control supply of fuel to the idle fuel ports located downstream of the main fuel nozzle in the vicinity of the throttle valve of the carburetor. In order to overcome the change in A/F with ambient temperature changes, it has been recognized that it is beneficial to have a fuel jet (metering orifice) that becomes larger in flow cross section as the ambient temperature decreases, and smaller in flow cross section or area as the temperature increases. Unfortunately, this is opposite to the normal co-efficient of linear expansion of metals, plastics, etc.

One prior successful solution to the aforementioned problems is that set forth in U.S. Pat. No. 4,759,883 issued in the names of John C. Woody and Mark S. Swanson and assigned to the assignee of record herein (which is incorporated herein by reference). In the '883 patent a temperature compensated carburetor is disclosed having a fuel metering system including a variable restriction needle gate valve for varying the effect of flow cross-sectional area of the main and/or idle fuel supply duct to modulate the flow rate of fuel to the carburetor venturi mixing passage. The needle gate valve is made of plastic material having a much greater coefficient of expansion than the aluminum carburetor body in which it is adjustably mounted. Hence differential linear expansion and contraction of the needle valve relative to the carburetor body in response to ambient temperature changes varies the flow-controlling cross-sectional area of the fuel duct inversely relative to ambient temperature changes. The needle valve is a rod-like body with a threaded cylindrical mounting portion at one end threadably secured in a threaded bore in the carburetor body. A reduced diameter extension of the needle body extends axially away from the mounting end of the needle body and has a cylindrical stem portion slidable in another bore of the carburetor body. The needle body is unrestrained linearly from the free end of the stem portion to the threaded mounting of the needle body. The free end of the stem is movable in a fuel feeding duct of the main nozzle and/or idle system passageway fuel ducts to thus vary its flow controlling cross-section.

In the preferred embodiments disclosed in the '883 patent, the temperature compensating fuel metering valve is constructed such as to create turbulent flow rather than laminar flow because much less differential movement between the valve and its associated body passageway is required in order to achieve the same degree of temperature compensation. With laminar flow needle valve arrangements the mass fuel flow rate is greatly dependent upon changes in fuel viscosity as well as density with temperature. Hence a much greater change in flow controlling cross-sectional area is required to achieve the same change in mass flow rate as compared to a compensating valve construction wherein turbulent flow is produced past the flow controlling cross-section zone. In other words, with turbulent flow valve constructions the effect of temperature-induced viscosity changes is essentially nullified so that only temperature-induced changes in fuel density need be considered in designing the variations in size of the flow controlling cross-section of the passageway. Thus the turbulent fuel flow metering embodiments of the '883 patent are preferred from the standpoint of reduction in overall size and cost and for greater simplicity and reliability. They also enable a very minute travel of the fuel needle to be effective in temperature compensation for the carburetor.

Nevertheless, it has been found that several problems still remain for solution. Due to the necessarily small overall size limitations imposed on carburetor designs for many applications in the small engine field the overall length of the rod-like body utilized for a needle valve in the '883 patent must likewise be limited. This in turn imposes maximum limitations on the amount of differential travel and hence maximum limits on amount of flow cross-sectional variation that can be produced by this particular type of temperature compensation device.

Also, in some applications and in certain carburetor designs the velocity of fuel flow being aspirationally fed to the mixing passage is insufficient to reach turbulent flow conditions regardless of the manner in which the flow controlling valve is designed, at least in certain portions of the range of operating flow rate existing in the feeding passageway(s) leading to the carburetor mixing passage. For example, the range of flow rate velocity in the idle circuit of the carburetor may be such as to impose laminar flow conditions throughout most, if not all, of the flow rate range in this fuel feeding circuit. Therefore the amount of valve travel relative to the controlled cross section of the fuel feeding passage modulated by movement therein of a compensating valve may be on the order of several times the maximum travel obtainable by differential expansion between a rod-like needle valve and the carburetor body mounting structure in which it is anchored.

In these and other applications it has also been found that it would also be desirable to somehow modulate the carburetor operational curve of A/F versus ambient temperature in a manner which imparts reversals in A/F at certain points in the range of ambient temperature changes to thereby optimize engine performance in response to other operational and ambient conditions for given engine appliance applications. Such reversals in the A/F curve are not obtainable utilizing the temperature compensating needle valve of the '883 patent as disclosed therein.

Additionally, it has been found to be desirable to provide a temperature compensating system in which the end limits as well as reversal set points in the A/F curve can be adjusted, either in the initial set up as manufactured or in the field by qualified service personnel, a mode of operation also not disclosed in the '883 patent.

OBJECTS OF THE INVENTION

Accordingly, it is an object of the present invention to provide an improved fuel metering system, apparatus and method, particularly for a carburetor of the class described, which is automatically responsive to changes in ambient temperature and operable to reduce or eliminate, or otherwise desirably modulate, changes in the A/F output of the carburetor as induced by ambient temperature changes, Additional objects of the present invention are to provide a carburetor fuel flow control valve construction of the aforementioned character which is simple, of low cost construction, rugged and reliable in operation, capable of replacing the conventional idle and high speed fuel adjustment needles, factory adjustable and then sealable against tampering or misadjustment in the field, readily installable in a carburetor, requires a minimum of design changes in the carburetor fuel feeding passageways and does not significantly increase the overall dimensions of the carburetor.

A further object is to provide a carburetor temperature compensating fuel metering system, apparatus and method of the aforementioned character which is readily combinable with that of the aforementioned '883 patent to provide further adjustments and modulations of the desired engine-carburetor performance curves of A/F against ambient temperature change.

SUMMARY OF THE INVENTION

Briefly, and by way of summary description and not by way of limitation, in general the objects of the invention are accomplished in accordance with the invention by providing a small engine diaphragm or float-type carburetor in which the fuel-flow-controlling gate valve needle of the '883 patent is fixed, at its end remote from the fuel control passageway to the moveable free end of a bi-metal strip which in turn is fixed at its other end to the carburetor body. A composite valve member is thus provided in which the bi-metal strip generates substantially all of the temperature-change-induced movement of the flow controlling valve needle. Hence, for the same size needle the operative range of fuel flow controlling movement, for a given increment of temperature change, is increased on the order of two to five times that of the needle valves 42 and 80 as disclosed in the '883 patent.

In addition, although the composite valve member is unrestrained in the direction of its flow controlling movement through a given desired travel range, one or two travel end limit stops may be provided to control temperature compensation action at one or two predetermined ambient temperature set points. Such stops prevent movement of the bi-metal free end despite ambient temperature changes ocurring beyond one or both of these end limit set points thereby allowing the carburetor to operate in an unregulated fashion beyond one or both of the set points. In this manner, the A/F to temperature performance curve of the carburetor can be modulated to provide for example, an optimum lean mixture at room temperature and a progressively richer mixture as temperature varies in either direction from the room temperature set point. The second set point can be utilized to further modulate the performance curve to more nearly approximate an overall constant A/F plot throughout the entire expected ambient temperature operational range, such as from −40° C. to 50° C. Additionally, if the needle gate valve is itself made responsive to temperature changes as in the '883 patent the composite valve member can provide further modulation of the performance curve as may be desired for certain applications.

Preferably a right-angle interconnection of the needle and bi-metal strip in this composite valve member linkage is utilized to advantage to compactly mount the strip flat against an exterior face of the carburetor body so that the overall size of the carburetor is not appreciably increased. An operational compartment may be provided for the bi-metal strip and associated remote end of the needle by providing a suitable cover structure. The adjustable travel limit stops are preferably arranged in this compartment to provide a convenient factory set-up adjustment structure which also can readily be made tamper-proof in the field.

Moreover, due to the much greater flow compensating movement provided by the bi-metal strip of the composite valve member, the gate valve needle itself may be made of inexpensive brass or aluminum material. Also the valve needle alternatively may be constructed and arranged to function as a conventional conical fine point needle valve to provide temperature compensation even under laminar flow conditions in the valve controlled portion of the fuel passageway of the carburetor, if desired. As in the '883 patent, the composite valve member can be provided to serve as either or both the high speed or idle fuel metering valve of the carburetor.

BRIEF DESCRIPTION OF THE DRAWINGS

Other objects as well as features and advantages of the present invention will be more fully understood and become apparent from the following detailed description, appended claims and accompanying drawings, wherein the principles of the invention are set forth together with the details of construction and operation in connection with the best mode presently contemplated for the practice of the invention, and wherein the accompanying drawings and the various views thereof may be briefly described as:

DETAILED DESCRIPTION OF PREFERRED EMBODIMENTS

First Embodiment

Figure 2:
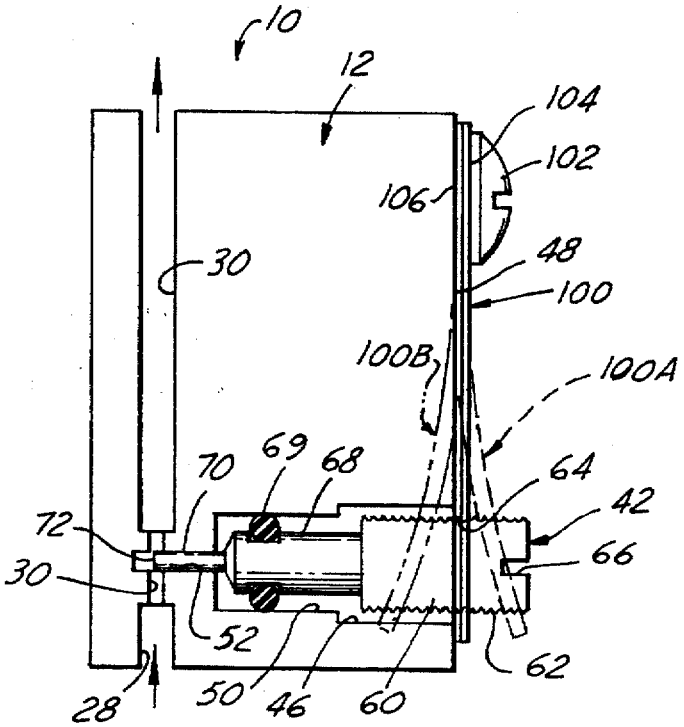
FIG. 2 is a simplified diagrammatic view of a carburetor incorporating a first embodiment of a temperature compensating device of the invention and operable to produce the improved performance curve shown in broken lines in FIG. 1.
Figure 3:
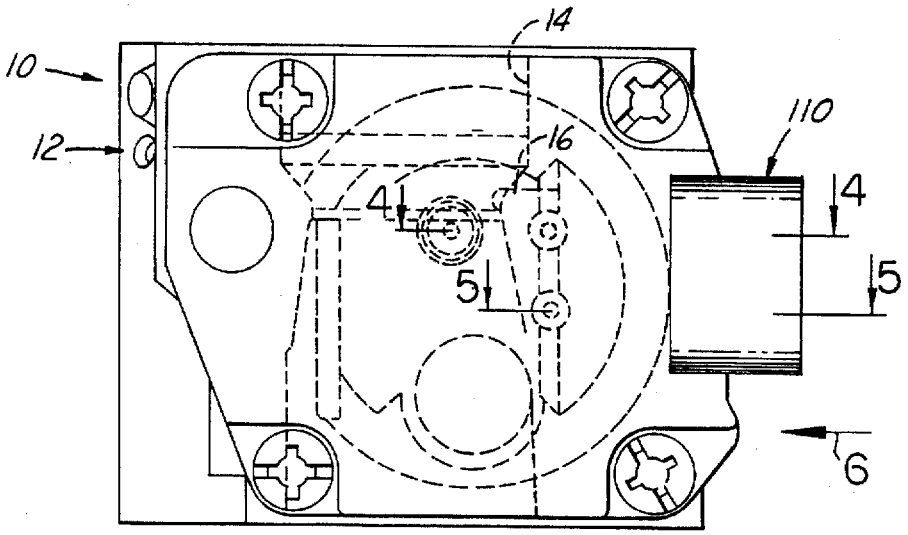
FIG. 3 is a top plan view of a small engine carburetor incorporating a second embodiment of the present invention.

Referring in more detail to the accompanying drawings, FIG. 2 illustrates in simplified diagrammatic form a portion of a carburetor 10 provided with a first embodiment of a temperature compensation system and device of the invention in which reference numerals alike to those of the aforementioned '883 patent are utilized for corresponding elements illustrated and described herein convenience and comparison in description. Carburetor 10 and its body 12 are also described in more detail in conjunction with the second embodiment of the invention illustrated in FIGS. 3–6 and described in more detail hereinafter.

Thus, in general, the first embodiment of the invention is applied to a carburetor 10 having a mixing passage 16, a fuel supply chamber 20, fuel duct means 28, 30, 32, 34, 26 to conduct fuel from chamber 20 to the mixing passage 16, and a fuel metering system associated with the fuel duct means including variable restriction means 42 for varying the effect of flow cross-sectional area of the fuel duct means to modulate the mass flow rate of fuel to the mixing passage. The variable restriction means comprises support means in the form of the aluminum body 12 of the carburetor 10, and fuel metering means comprising a bi-metal strip 100 and high speed needle valve 42 carried at the free end of strip 100. Needle 42 has a gate valve stem 70 with a flat end face 72 movable in passage 30 for defining and thus controlling the flow cross-sectional area of passage 30. Differential expansion and contraction of the fuel metering means 100, 42 relative to carburetor body 12 in response to fuel temperature changes caused by ambient temperature changes varies the flow-controlling cross-sectional area of the fuel duct 30 inversely relative to such temperature changes to thereby modulate temperature-dependent fuel density changes so as to reduce resultant mass fuel flow rate variations.

Bi-metal strip 100 is fixed at one end to body 12 by a mounting screw 102 to lay flat against the flat exterior face 48 of carburetor body 12 (at ambient room temperature, i.e., 72° F. or 20° C.) to thereby provide the mounting means for the fuel metering needle 42. Valve needle member 42 of the fuel metering means is likewise provided at its outer end with threads 62 which thread into internal threads 64 of a through-hole in strip 100 to thereby adjustably fix valve member 42 to strip 100, preferably with the axis of needle 42 oriented perpendicular to the longitudinal axis of strip 100. Stem 70 of needle 42 as well as its shank 68 and a portion of its valve body 60 between shank 68 and strip 100 thus comprise an extension of the valve member 42 extending longitudinally away from the fixed end of the needle 42 in associated strip 100 and terminating at free end stem 70 which is slidable in bore 52 of the carburetor support body 12. Needle 42 and associated strip 100 are thus unrestrained by carburetor body 12 from free end 70 to the remote end of strip 100 fixed to body 12 by screw 102 to permit temperature responsive control movement of stem 70 and its end face 72 in fuel passage 30.

As illustrated in FIG. 2, strip 100 is disposed flat against body face 48 to establish a room temperature position of needle 42. Needle 42 is pulled to the right as viewed in FIG. 2 as ambient temperature drops below 20° C. by resultant warpage of strip 100 to the bowed condition thereof illustrated in exaggerated form by the borken lines 100A in FIG. 2. The free end face 72 of the combined valve member-strip 42,100 is thus movable in fuel passageway 30 to define therewith its flow controlling cross-sectional area. Thus differential expansion and contraction of the composite variable restriction means 42,100 relative to its support means (screw 102 in body 12) in response to fuel temperature changes (which track ambient temperature changes) causes movement of the free end 70 in a direction and amount to effect the desired variation in flow controlling cross-sectional area of the duct 30. In this embodiment the movement of stem 70 at its free edge 72 is in a direction transverse (preferably perpendicular) to the direction of fuel flow in passage 30 (indicated by the arrows in FIG. 2) in the zone of the flow controlling cross-sectional area. Moreover, stem 70 and its freed edge 72 are preferably configured relative to such direction of operative valve member movement and to the fuel passageway to create turbulent flow of the fuel as it flows through the flow-controlling cross-section zone. Accordingly, in a preferred embodiment the effect of temperature-induced viscosity changes in the fuel is essentially nullified, and essentially only temperature-induced changes in fuel density are compensated by such differential expansion and contraction variation of the flow-controlling cross-sectional area.

It will thus be seen that the present invention as illustrated in the first embodiment of FIG. 2 follows the principles as disclosed and claimed in the aforementioned U.S. Pat. No. 4,759,883, while also providing an improvement thereover in terms of the further features embodied therein as described hereinafter.

In accordance with one principal feature of the present invention the primary active element of the variable restriction means producing movement of the free end stem 70 of the fuel metering means is the bi-metal strip 100 rather than the material of the portions 60, 68 and 70 of valve body 42 extending between its free edge face 72 and strip 100. Indeed, in the embodiment of FIG. 2 valve member 42 may if desired be made of the same material, namely aluminum, as carburetor body 12, or of some other suitable material such as brass having a similar co-efficient of expansion as that of the aluminum material of body 12.

Strip 100 may be in the form of a conventional bi-metal strip made up of an outer strip of metal 104 bonded in the conventional manner to an inner strip of metal 106, with outer strip 104 having a linear co-efficient of expansion greater than that of inner strip 106 (as well as that of material of body 12). Bi-metal strip 109 is preferably designed such that at room temperature the longitudinal axis of strip 100 is linear in its free state condition so that when it is mounted by screw 102 to body 12 strip 100 lies flat against body face 48 at room temperature. Thus, when ambient temperature drops from room temperature, causing a corresponding drop in fuel temperature being fed through carburetor 10, the corresponding drop in temperature of bi-metal 100 causes outer strip 104 to contract at a faster rate than inner strip 106, thereby producing a bowing or warpage in the bi-metal strip towards the outwardly flexed condition illustrated in exaggerated style at 100A in FIG. 2. The resultant movement of the free end of strip 100 pulls needle 42 outwardly relative to body 12 (to the right as viewed in FIG. 2) during this outward flexture to thereby increase the cross-sectional area of the effective flow controlling cross-sectional area between face 72 and the associated portion of duct 30. This differential contraction of the fuel metering means is thus effective to compensate for temperature-induced changes in fuel density to thereby modulate the plot of A/F against fuel/ambient temperature in a desired controlled manner.

In accordance with another feature of the present invention, the structural geometry of the mounting of the composite variable restriction means 42,100 relative to its support means 12, 48, 102 operates to disable movement of the free end 70/72 of valve member 42 in a passage-closing direction (to the left as viewed in FIG. 2) from its room temperature position shown in FIG. 2. Thus, as ambient temperature increases above room temperature strip 104 tends to expand at a faster rate than strip 106, tending to bow bi-metal 100 toward the inwardly warped condition theoretically shown in exaggerated style at 100B in FIG. 2. However, due to the clamping pressure of screw 102 forcing strip 100 against face 48 of carburetor body 12, with the free end of strip 100 bridging body opening 46, bi-metal 100 is constrained against such inward bowing deflection despite the increasing temperature-induced stress build-up in strip 100.

Figure 1:
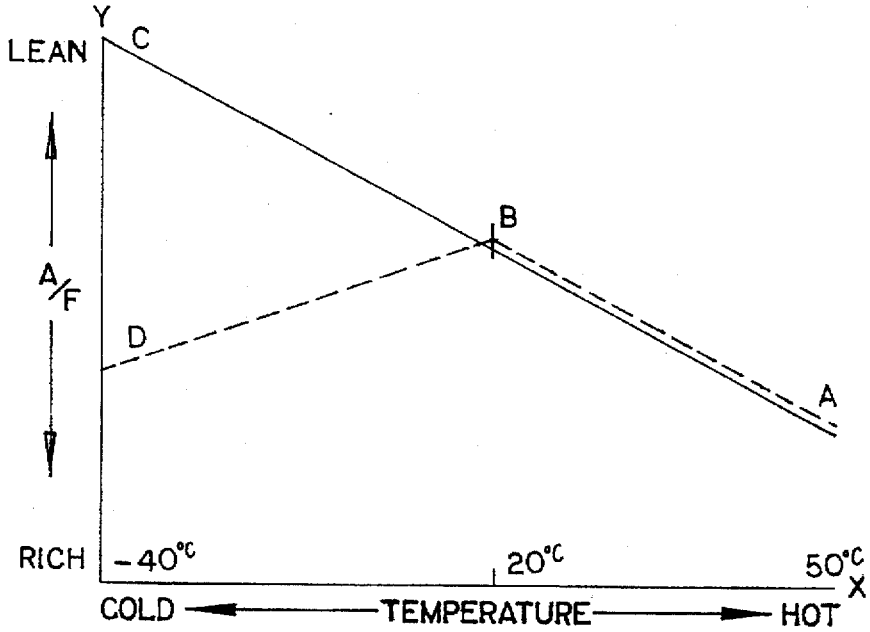
FIG. 1 is a simplified diagram of an engine-carburetor performance curve plotting air-to-fuel ratio (A/F) against ambient temperature for both a non-compensated carburetor (solid line curve) and a carburetor incorporating temperature compensation in accordance with a first embodiment of the invention (broken line curve)

This feature enables the temperature compensated fluid flow metering system of the present invention to operate in the embodiment of FIG. 2 in accordance with the performance curve illustrated in simplified fashion in FIG. 1. In this graph the abscissa (X-axis) represents a plot of ambient temperature, and hence corresponding fuel temperature being fed to the carburetor, the temperature values being plotted in a range from −40° C. to 50° C. in equal linear increments of temperature degrees. The ordinate (Y-axis) of the FIG. 1 plot represents the resultant air-to-fuel ratio (A/F) in the output of the mixing passage of the carburetor, in linear increments of the numerical ratio from a rich mixture (zero point) and becoming leaner with increasing ordinate values. The solid line curve A-C represents the typical, generally linear reduction in A/F, going from leaner to richer, as the fuel temperature in the fuel feeding passage of the carburetor rises from −40° C. to 50° C., with a corresponding increase in ambient temperature. This typical performance curve of an uncompensated carburetor thus deviates undesirably from a constant value of A/F as plotted against ambient temperature changes.

In accordance with the embodiment of the system of the invention shown in FIG. 2, the uncompensated performance curve A-C is modified to follow the performance plot A-B-D as shown in FIG. 1. Assume for example that the end face 72 of stem 70 has been positioned by threaded adjustment of needle 42 in strip 100 so as to be disposed flush with the central axis of bore 30 at a standard ambient adjustment temperature, e.g., room temperature (20° C.; 72° F.), and that the components are oriented and arranged as shown in solid lines in FIG. 2. Under these conditions the value of A/F will be represented on the Y-axis by point B on the A-B-D curve corresponding to 20° C. on the X-axis. Hence as ambient temperature drops from 20° C., strip 100 will tend to bow toward the position 100A, away from face 48, causing the lower, free end of strip 100 to pull needle 42 to the right as viewed in FIG. 2, thereby increasing the flow controlling cross-section defined in passage 30 past stem 70 and its end face 72. Thus in the range of decreasing temperature between points B and D (20° C. down to −40° C.) the position of end face 72 in passage 30 will vary as a function of the temperature of the liquid fuel filling chamber 20 and flowing through the passage 30. Thus in turn is a direct function Of the fuel tank temperature which, in most instances, will be essentially at or representative of outdoor ambient air temperature. Thus as outdoor ambient air temperature drops from 20° C. and the air flowing through the carburetor becomes denser, and likewise fuel density and viscosity increase, the resulting differential contraction of strip 100 will move stem 70 and its face 72 to the right as viewed in FIG. 2, thereby reducing the obstruction of gate valve stem 70 to fuel flow through passage 30. Hence the fuel flow rate in the passage tends to increase to match the increase in air density to maintain, in the illustrated example, an increasing fuel-to-air mass ratio (i.e., slope of portion B-D of curve A-B-D) even though the fuel becomes denser and more viscous.

On the other hand, an increase in temperature of strip 100 over its standard ambient set-up temperature at point B (20° C.) can not cause movement of the free end of valve member 42 in a passage-closing direction beyond its set point as shown in FIG. 2. Hence temperature compensation in this system is disabled at ambient temperatures above set point B. Therefore the plot B-A of A/F against ambient temperature for curve A-B-D is the same as that for curve A-C in the temperature range from ambient (20° C.) up to the illustrated maximum temperature (50° C.).

The resultant performance curve A-B-D thus can be established by the system of the invention to meet certain customer requirements; for establishing a peak lean out of A/F at room temperature, with the A/F going richer with the temperature deviation in either direction from this set point. Thus at colder temperatures, a proportionate enrichment of A/F is provided to assist in easier engine starting as well as to help engine acceleration as temperatures become colder. On the other hand when operating in warmer temperatures, above 20° C. the proportionate increase in A/F enrichment from maximum lean at point B is useful in tending to reduce the onset of vapor lock and the various engine and appliance operational problems associated therewith. The system of FIGS. 1 and 2 thus provides slope reversal performance curve (portion B-D versus portion B-A) of A/F to ambient temperature change as distinguished from the uncompensated A-C curve or even a flat curve (A/F remaining constant with temperature changes).

Second Embodiment

Referring to FIGS. 3–6, carburetor 10 is shown in more detail and also incorporates a second embodiment of the present invention. Carburetor 10 has the usual die cast and machined aluminum body 12 provided with a mixing passage 14 extending through body 12 and open at its opposite ends. Mixing passage 14 includes the usual venturi section 16 which may be provided with the usual throttle and choke valve plates (not shown).

Figure 4:
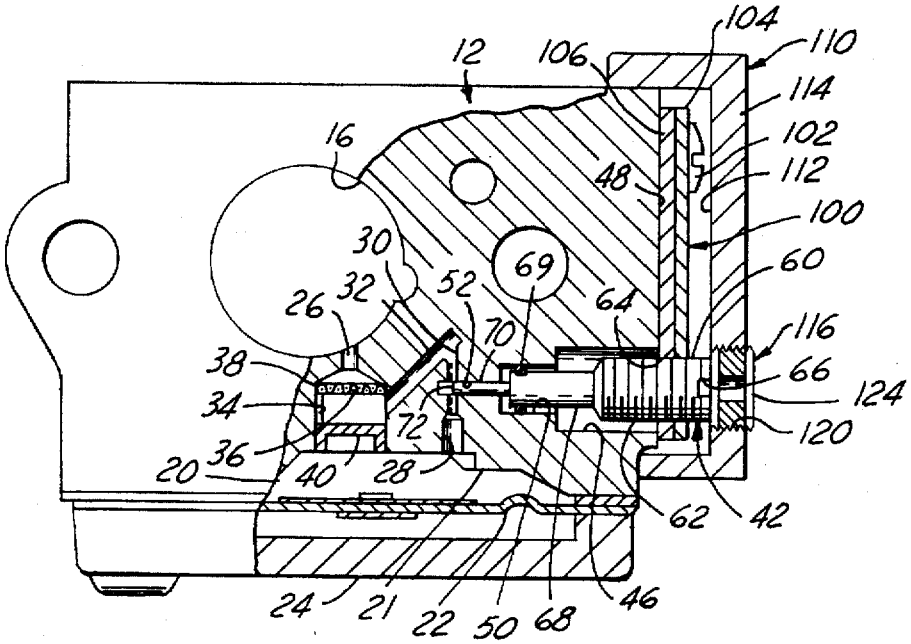
FIG. 4 is a vertical cross-sectional view taken on the line 4—4 of FIG. 3.

Referring to FIG. 4, a diaphragm chamber 20 at one surface of the carburetor body, i.e., bottom surface as shown in FIG. 4, is formed by the body face 21 of body 12 and a diaphragm 22 held in place by a cover plate 24. In accordance with conventional practice, diaphragm 22 controls a springed biased lever (not shown) which in turn controls an inlet valve (not shown) for admitting fuel to chamber 20. Carburetor 10 thus may be of the type shown in U.S. Patent to Charles H. Tuckey, U.S. Pat. No. 3,758,084, issued Sep. 11, 1973, as well as U.S. Pat. No. 4,001,354, issued Jan. 4, 1977, both assigned to the assignee of the present application, the same being modified in accordance with the principles and details of the present invention as described herein, and the same also being incorporated herein by reference.

Thus, liquid fuel (gasoline) is fed from a fuel tank (not shown), usually engine or appliance mounted, to the diaphragm chamber 20 from a pumping system (not shown), which may be a built-in diaphragm-type as shown in the aforementioned patents or from a separate fuel pump. Such fuel is then fed from diaphragm chamber 20 to a main nozzle outlet 26 in venturi 16 via an interconnected series of communicating passages 28, 30, 32 and 34. Passage 34 is provided with the usual anti-back bleed screen 36 held by a retainer ring 38, and the bottom of passage 34 opening to chamber 20 is closed by a press fit cap 40.

Figure 6:
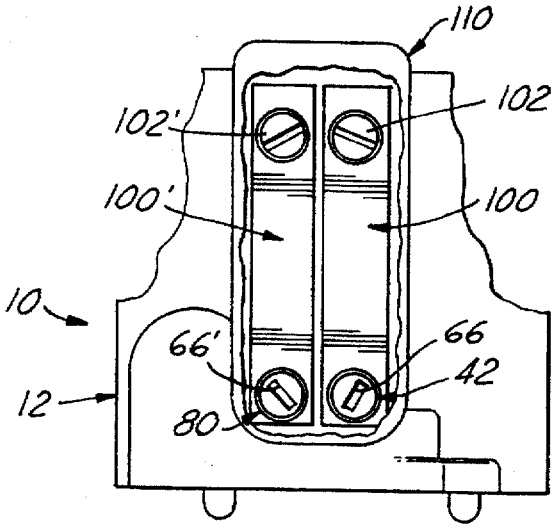
FIG. 6 is a fragmentary end elevational view taken in the direction of the arrow 6 of FIG. 3, with portions broken away to illustrate interior details.

In accordance with aforementioned feature of the present invention, fuel flow between diaphragm chamber 20 and main nozzle 26 is again controlled by a temperature compensating composite bi-metal strip 100 and needle gate valve 42, the same being shown installed in body 12 in FIGS. 4 and 6. Body 12 is drilled to provide a series of coaxial cylindrical bores of progressively reduced diameter, comprising a bore 46 open at its outer end at the exterior face 48 of body 12 and open at its other end to a slightly reduced diameter counterbore 50. Counterbore 50 in turn opens to a relatively narrow diameter bore 52 which extends across fuel passage bore 30 such that the axes of bores 30 and 52 intersect perpendicularly. In one working example the diameter of bore 30 is 0.026 inches and the diameter of bore 52 is 0.040 inches.

Needle 42 has a main body portion 60 (FIG. 4) which is provided with external threads 62 which are adapted to threadably engage internal threads 64 provided in a through-hole of bi-metal strip 100. A screw driver slot 66 is provided at the outer end of needle 42 to facilitate screwing needle 42 into strip 100 and for operational adjustment of the same. Needle 42 has a reduced diameter shank 68 which extends from body portion 60 into counterbore 50 with a relatively large clearance therebetween. Shank 68 has an annular external groove which carries an O-ring 69 that slides in and seals counterbore 50.

Shank 68 terminates at its inner end in the cylindrical stem 70 which slides with a close fit in bore 52. Preferably, end face 72 of stem 70 is again positioned by threaded adjustment of needle 42 so as to be disposed flush with the central axis of bore 30 at a standard ambient adjustment temperature, which for example, and convenience in manufacture, may be room temperature.

Figure 5:
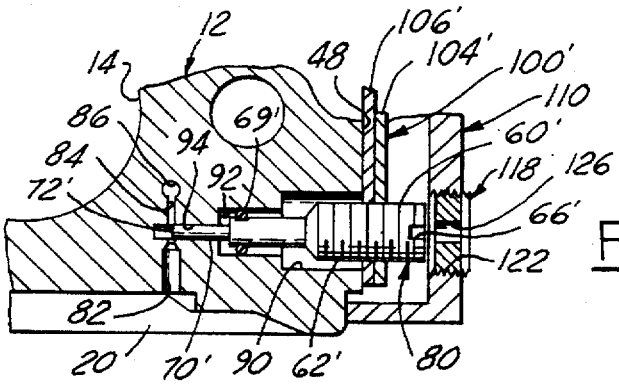
FIG. 5 is a fragmentary vertical cross-sectional view taken on the line 5—5 of FIG. 3.

In accordance with a further feature of the present invention, carburetor 10 is also provided with a low speed temperature compensating system which as shown is in the form of temperature compensating composite fuel regulating needle gate valve 80 and associated bi-metal strip 100 shown installed in FIGS. 5 and 6 to control fuel flow from chamber 20 to the idle nozzle outlets of the carburetor (not shown) via interconnected fuel passages 82, 84 and 86. Needle 80 and strip 100' are also mounted on and in body 12 adjacent strip 100 and needle 42, and preferably are identical in construction to strip 100 and needle 42. However, if desired, the length between face 72' and body portion 60', i.e., the combined length of shank 68' and stem 70' may differ from the length of the corresponding portions of needle 42. The operative lengths of strips 100' may also differ from strip 100. This "free length" difference may be provided to accommodate the smaller diameter of idle passage 84 as compared to main passage 30 while still maintaining the same percentage change in the flow controlling cross section of the respective passages. Needle 80 is inserted with a large clearance into the exterior open end of a bore 90 open at its outer end at face 48, and which connects at its inner end to a slightly reduced diameter counterbore 92, which in turn connects to a small diameter bore 94 which crosses fuel passage bore 84, the axis of these bores also intersecting perpendicularly. The stem 70' of needle 80 has a close sliding fit in bore 94 and its end face 72' is disposed flush with, or close to, the axis of bore 84 at the aforementioned standard adjustment temperature. Shank 68' also has an annular external groove which carries an O-ring 69' that slides in and seals counterbore 92.

In accordance with yet another feature of the present invention, needles 42 and 80 are threadably adjusted by using a screw driver or the like such that the associated stems 70 and 70' variably protrude into passages 30 and 84 respectively to function as fuel-flow-controlling gate valves in these passages. In this respect, needles 42 and 80 are operated in much the same manner as conventional carburetor needle valves, and hence their installation and adjustment procedure, as well as their position in the carburetor, will be readily understood by engine operators and service personnel familiar with prior art small engine carburetors.

However, in accordance with still another feature of the embodiment of the present invention shown in FIGS. 3–6, bi-metal strips 100 and 100' may be combined with needles 42 and 80 made in accordance with the '883 patent disclosure and claims, i.e., in one piece from a selected plastic material having a co-efficient of linear expansion several orders of magnitude greater than that of the metal, usually aluminum or an aluminum alloy, from which body 12 in the carburetor is constructed. Thus, in one working example, body 12 may be constructed of an aluminum alloy having a co-efficient of expansion $22.39\times10^{-6}$ inch/inch/°C., and needles 42 and 80 may be injection molded and machined from Delrin brand acetyl plastic having a co-efficient of expansion of $100\times10^{31\ 6}$ inch/inch/°C. The length of stem 70, 70' and shank 68, 68' is designed so as to produce a predetermined finite range of movement of face 72, 72' relative to the anchor points of the needles in strips 100 and 100' through the usual or expected range of ambient operating temperatures, usually −40° to +50° C. The diameters of bore 30 and 84 are selected to match the fuel flow requirements of the carburetor application. Thus, the diameter of idle passage 84 may be 0.0156" as compared to the aforementioned diameter of main fuel control passage 30, but the diameter of passage 94 may again be 0.040 inches.

At the standard set up temperature the high and low speed needles 42 and 80 are rotatably threadably adjusted in strips 100 and 100' when oriented as shown in FIGS. 4 and 5 to provide the proper air-fuel ratio during various engine operating conditions at the standard ambient set up temperature. Faces 72 and 72' are thus suitably positioned in passages 30 and 84 respectively such that stems 70 and 70' provide the proper amount of obstruction to fuel flow therethrough in much the same manner as initial set-up engine tuning adjustment is accomplished with conventional prior art needle valves.

In operation of the embodiment of carburetor 10 shown in FIGS. 3–6, the temperature of needles 42 and 80 and bi-metal strips 100 and 100' again will generally closely track with, or be substantially the same as the temperature of the liquid fuel filling chamber 20 and flowing through the main and idle passages to the main and idle fuel nozzles of carburetor 10. The fuel temperature in turn will be primarily determined by the fuel tank temperature which, in most instances, will be essentially at or representative of outdoor ambient air temperature. Since the needles 42 and 80 have approximately five times the expansion co-efficient of the aluminum material of body 12, and since the needles are locked in place along their threaded end portions 60 and 60' by the threaded engagement thereof with strips 100 and 100' respectively differential expansion and contraction will occur between both the bi-metal strips and the needle Delrin plastic material on the one hand, and the carburetor body aluminum material on the other hand, due to the needle material and their mounting to body 12 via associated bi-metal strips 100 and 100', resulting in elongation and contraction linearly or axially of shanks 68, 68' and stems 70 and 70' relative to their associated mounting in strips 100 and 100' and controlled bowing of the bi-metal strips. Thus, the positions of end faces 72 and 72' in passages 30 and 84 respectively will vary as a function as the temperature of the needles 42 and 80 and strips 100 and 100', which in turn is a direct function of the temperature of the fuel being fed to the carburetor mixing passage 14, and thus as an indirect function of outdoor ambient temperature.

Thus, as outdoor ambient air temperature drops and the air flowing through the carburetor becomes denser, and likewise fuel density and viscosity increase, the resulting contraction of needles 42 and 80 and warpage of strips 100 and 100' toward position 100A (FIG. 2) will move stem faces 72 and 72' relative to their mount in strips 100 and 100' as well as in passages 30 and 84 to the right as viewed in FIGS. 4 and 5 thereby reducing the obstruction of the gate valve stems 70 and 70' to fuel flow through both passages 30 and 84 respectively. Hence, the fuel flow rate in these passages tends to increase to match the increase in sir density to maintain a constant fuel-to-air mass ratio even though the fuel becomes denser and more viscous. On the other hand, an increase in temperature of the needles over their standard ambient set-up temperature will cause lineal expansion of shanks 68, 68' and stems 70 and 70' relative to their mounting in strips 100 and 100'. Although movement of the free ends of strips 100 and 100' is now prevented by body face 48, end faces 72 and 72' can still move slightly to the left as viewed in FIGS. 4 and 5 due to such needle expansion. Hence the needles alone can now increase the obstruction of the gate valve stems 70, and 70' to fuel flow in passage 30 and 84 respectively. Again this tends to maintain a more constant fuel-to-air mass ratio (i.e., a lesser slope in curve B-D) in the output of carburetor 10 despite the fuel becoming less dense and lower in viscosity, and the ambient air also becoming less dense.

It thus will now be understood that the parameters determining fuel flow rate and the desired fuel-air ratio of the carburetor output can be determined in accordance with known engineering principles and practice and co-related with the amount of movement of the stems 70 and 70' both individually and combined with the movement of the free end of associated bi-metal strips 100 and 100' as required to modulate fuel flow throughout the range of temperature conditions expected. Preferably, the obstruction to fuel flow is normally varied, considering only needle expansion and contraction independent of bi-metal strip-induced movement, only enough to vary the effective flow-controlling cross-sectional area of fuel passages 30 and 84 by about 1.01% per 10° C. temperature change, i.e., about a total of 6.06% in a temperature range of −20° C.. to +40° C., in direct response to temperature modulated movement of the gate valve stems 70 and 70'.

However, the designer has available a selection of materials and dimensional relationships with respect to the bi-metal strips 100, 100', to the needles and to the flow passages controlled thereby that can be tailored to effect greater or less fuel flow rate modulation as may be required to satisfy the expected operating environment for a given carburetor.

It is also to be understood that the clearance between the stems 70 and 70' and their respective bores 52 and 94 is established to provide a sliding clearance even at the maximum operating temperature. Hence at coldest operating conditions, there is a leakage clearance between these stems and their bores 52 and 94. Nevertheless, the chambers defined by bores 50 and 46 surrounding shank 68, and by bores 92 and 90 surrounding shank 68', are respectively sealed closed by the O-rings 69 and 69' and hence such leakage does not effect the operation of the carburetor.

The design dimensions and materials of a presently preferred embodiment of FIG. 2 as disclosed herein, in addition to those specified previously hereinabove, and including the actual travel distance of the control face 72 in the associated fuel duct and the range of temperature of needle 42 preferably is as follows for operation in the mode of FIG. 1:

| | |
|---|---|
| Material of needle 42: | Steel |
| length of 60: | .300 inches |
| length of 68: | .250 inches |
| length of 70: | .150 inches |
| Relative Movement of Face 72 versus Bore 30 from +20° C. to +50° C. (30° C. range): | .0015 inches |

Total flow area ratio change over 30° C. range: 7.03%

Change in flow area per 10° C. temperature change: 2.34%

Specifications of Bi-Metal 100:

Manufacturer: Texas Instruments, 34 Forest St., Attlebord, Mass. 02703

| | |
|---|---|
| Model No.: | Truflex B1 |
| Length: | .5 inches |
| Width: | 0.312 inches |
| Thickness: | 0.070 inches |

It is to be further understood that bore 52 may intersect bore 30 at an angle other than a right angle, and the same is true with respect to the angle of intersection of bore 94 with bore 84. Moreover, the respective axes of these intersecting bores may, if desired, be offset from one another to a slight extent rather than being coincident as set forth in the foregoing preferred examples of FIGS. 1 through 8.

Moreover, the shanks 68 and 68' of needles 42 and 80 may be manufactured to the same diameter as the associated stems 70 and 70' of these needles, since the diameter of the needle material is not a factor in the linear or axial expansion and contraction of the same with temperature changes. Hence, diameter is chosen as a function of manufacturing economy factors as well as strength and size considerations. Moreover, if a different relationship is desired between the percentage change in flow controlling area between the idle and main fuel passages, this can be readily accomplished merely by varying the materials and/or length dimension of the stem-shank portions 70-68 and 70'68' of needles 42 and 80 respectively and/or of bi-metal strips 100 and 100'.

However, it is to be understood that in both of the embodiments of FIGS. 1 and 2 and FIGS. 3–6 the temperature-change-induced movement of the flow controlling needles 42, 80 caused by the bowing of bi-metals 100 and/or 100' as ambient temperature drops from the set point of 20° C. is orders of magnitude greater than the movement the end faces 72, 72' relative to their mounting points in the strips. For example, such strip-induced movement for a temperature range of –40° C. to 50° C. may be in the range of 0.005 to 0.010 inches, as contrasted to corresponding movement of end faces 70 and 72 relative to their associated bi-metal strips, which may be in the range of only 0.00280 to 0.002245 inches. Due to this much greater control movement obtainable from the bi-metal portion of the valve mounting to the carburetor, temperature compensation can be contained in the idle system as in FIG. 5 even though fuel flow velocity in the passages 82, 84 and 86 never rises sufficiently to create a turbulent flow condition past end face 72' and stem 70' of valve 80. This bi-metal actuation thus permits needle 80, as well as needle 42 to be made in accordance with the previously described embodiment of FIG. 2, namely of brass or aluminum instead of the Delrin material described in conjunction with FIGS. 3–6, if desired.

Figure 7:
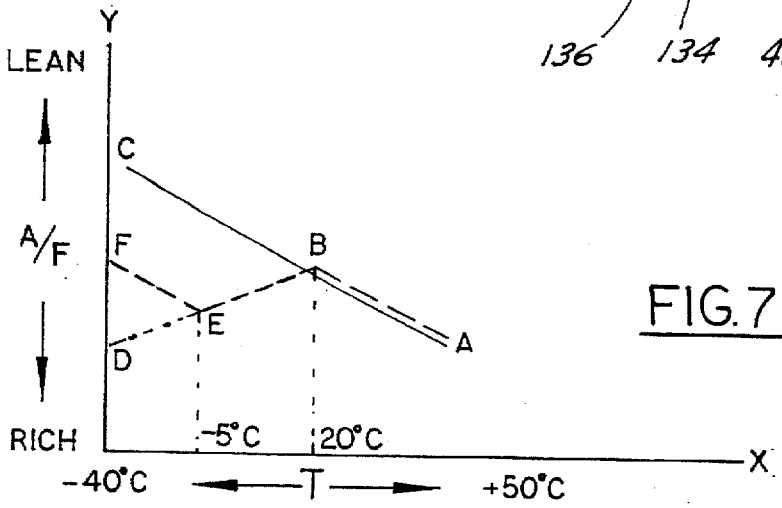
FIG. 7 is a simplified plot similar to that of FIG. 1 but illustrating a modification in the desired engine-carburetor performance curve which may be accomplished by adjustment of the second embodiment of the invention shown in FIGS. 3–6.

In accordance with still another feature of the second embodiment of the present invention, also illustrated in FIGS. 3–6, the A/F versus temperature performance curve of the carburetor may be controlled in accordance with the performance plot illustrated in FIG. 7. In this diagram the maximum lean-out set point D is again set at an ambient room temperature of 20° C.. Due to the constructional restraint of movement of the bi-metals at their free ends by body face 48 when temperature rises above 20° C., curve B-A in FIG. 7 is the same as curve B-A in FIG. 1. Likewise, as temperature drops below 20° C. the performance curve portion B-E may be the same as corresponding portion of curve B-D of FIG. 2. However, at point E on the curve shown in FIG. 7, corresponding for example to a temperature of –5° C., a second slope reversal can be induced in the performance curve so that the plot of A/F versus temperature change between –5° C. and –40° C. follows the curve E-F rather than the portion of curve B-D represented in FIG. 7 by the portion E-D plotted in FIG. 2. Thus the performance curve A-B-E-F of FIG. 7 resembles a shallow "W" to more nearly approximate an overall constant ratio of A/F to temperature change than either the uncompensated curve A-C or the compensation curve A-B-D of the embodiments of FIGS. 1 and 2.

This dual slope reversal characteristic of the system of FIG. 7 may be obtained by the provision of a second stop fixed to carburetor body 12. This second stop is preferably adjustable relative for variably limiting the outward bowing travel of the free ends of bi-metals 100 and/or 100' away from body face 48 toward the theoretical position 100A (FIG. 2). When such outward movement of the free ends of the strips is restrained by the second stop the A/F is permitted to lean out in an unregulated manner so as that portion E-F of the curve follows the slope of the B-C unregulated curve.

As illustrated in FIGS. 3–6 the second, slope-reversal travel stop may be provided in the form of an open box-like cover plate 110 suitably affixed to carburetor body 12 so as to overlie and enclose strips 100 and 100' and their associated needles 42 and 80. The inner face 112 of the web wall 114 of cover 110 is spaced a given distance outwardly away from strips 100 and 100' a suitable distance to permit a defined maximum amount of warpage thereof in a given selected range of temperature changes, such as –40° C. to 50° C.

The second strip movement stop is provided in the form of fillester head screw plugs 116 and 118 respectively threadably mounted in associated threaded openings 120 and 122 in wall 114 and individually respectively axially aligned with the outer ends of needles 42 and 80. Screws 116 and 118 can thus be individually threadable adjusted, to thereby establish the second set point to cause the second slope reversal at point E in the performance curve of FIG. 7, by the abutment of needles 42 and 80 respectively therewith. This stops outward travel of the free ends of the associated bi-metal strips when temperature reaches the second set point of –5° C. in the aforementioned example.

In order to facilitate factory set-up adjustment of the carburetor performance set points, plug stops 116 and 118 may have small diameter through-openings 124 and 126 coaxially aligned with the needle slots 66 and 66' of needles 42 and 80 respectively. Openings 124 and 126 are just large enough to permit insertion of a jeweler-size screw driver which can be inserted therethrough and engaged with the needle slots 66 and 66' to change the threaded setup adjustment of needles 42 and 80 in their threaded mounting in strips 100 and 100'. The small size of passages 124 and 126 thus is effective in most instances to forestall, if desired, field alteration of the set-up adjustment of the carburetor by the ultimate user of the appliance, while enabling trained personnel in the field to make this adjustment with the appropriate miniature screw driver or other properly sized instrument.

Third Embodiment

Figure 8:
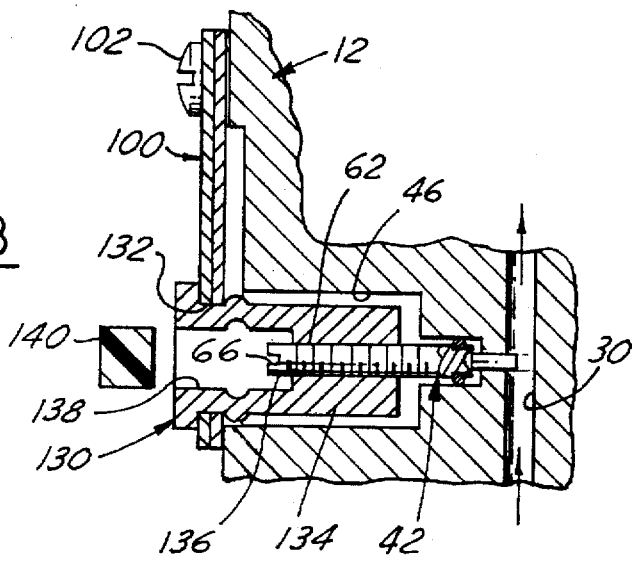
FIG. 8 is a fragmentary simplified cross-sectional view of a third embodiment of the invention.

In a third embodiment of the present invention illustrated on an exaggerated scale in FIG. 8, needle 42 is mounted to the associated bi-metal strip 100 by means of a commercially available rivet nut 130, such as that made and sold provided by Townsend Engineered Products a Division of Textron, Inc. Rivet nut 130 is inserted through a mounting hole 132 provided adjacent the lower free end of strip 100 so that its shank 134 is received with a loose clearance in bore 46 of body 12. Needle 42 is mounted with its threads 62 threadably received in the threaded passage 136 provided in nut 130 for threaded adjustment of needle 42 relative to nut 130. The larger unthreaded counterbore 138 provided in nut 120 provides exterior access to the screw slot 66 of needle 42. Nut 130 is rivet-deformation fastened around the margin of opening 132 in the usual manner of applying rivet nuts to securely retain the same on strip 100. If desired, in order to provide a tamper proof method of needle adjustment, a suitable soft plastic plug 140 may be pushed into counterbore 138 after set-up adjustment of needle 42 and nut 130. The squeeze press fit of plug 140 into nut 130 is effective in most instances to prevent customer readjustment of the carburetor in accordance with certain environmental regulations. It is to be understood that rivet nut mounting of needles 42 and 80 is also preferred in the embodiments of FIGS. 2–6 versus direct threading of the needles into the bi-metal strips.

From the foregoing description it will now be apparent that the present invention provides many advantages over the prior art. The fuel metering construction of the present invention is particularly suited for small engine carburetors and the like, and is responsive to changes in ambient temperature to reduce, eliminate or desirably modify unregulated changes in the fuel-air-ratio output of the carburetor induced by such ambient temperature changes. The carburetor fuel metering construction of the invention is simple and low cost in construction, rugged and reliable in operation, capable of replacing the conventional idle and/or high speed fuel adjustment needles, factory adjustable and then sealable against tampering or misadjustment in the field, readily installable in a carburetor, requires a minimum design changes in the carburetor fuel passages and does not appreciably increase the overall dimension of the carburetor.

Thus it will be appreciated that the preferred embodiments of the fuel metering devices for internal combustion engines described and illustrated herein amply fulfill the aforementioned objects of the invention. However, it will be realized that further variations of the inventive concepts will occur from the foregoing disclosures to those skilled in the art. For example, the invention is applicable to float carburetors as well as diaphragm carburetors. It will also be understood that the second adjustment travel stop for limiting outward bi-metal movement may be provided, in lieu of cover plate 110, by a milled or die cast slot in carburetor body 12. The bi-metal strips may be mounted to have a limited range of temperature-induced movement in this slot. Also, because of the much greater needle valve control travel available from bi-metal bowing versus needle material linear expansion and contraction, the invention is well adapted for A/F temperature compensation using conventional fine-taper-point needle valves under solely laminar flow conditions in the controlled passage. Therefore, the invention should not be considered limited to the preferred embodiments described hereinabove and shown in the drawings, that can be modified in various ways within the scope of the appended claims.

What is claimed is:

1. In a carburetor having a mixing passage, a fuel supply chamber, fuel duct means to conduct fuel from the chamber to the mixing passage, a fuel metering system associated with said fuel duct means including variable flow restriction means for varying the effective flow cross-sectional area of said fuel duct means to modulate the flow rate of fuel to said mixing passage, said variable flow restriction means comprising first and second structures defining said flow cross-sectional area and having different coefficients of expansion such that differential expansion and contraction of said first and second structures relative to one another in response to ambient temperature changes varies the flow-controlling cross-sectional area of said fuel duct means inversely relative to ambient temperature changes, said first structure comprising carburetor body support means containing said fuel duct means and having a first coefficient of linear expansion, said second structure comprising flow restriction means having a second coefficient of linear expansion considerably greater than said first coefficient of linear expansion, said flow restriction means having a fuel metering portion disposed in flow controlling relation with said fuel duct means and having a mounting portion secured in fixed relation to said support means and spaced from said fuel metering portion such that the differential expansion and contraction of said flow restriction means relative to said support means in response to the ambient temperature changes causes movement of said fuel metering portion in a direction to effect the variation in flow controlling cross-sectional area of said fuel duct means, the improvement in combination therewith wherein said variable restriction means comprises a needle body and said mounting portion comprises a bi-metal strip having a fixed end fixedly secured immovably to said support means and a movable free operably coupled to one end of said needle body, said fuel metering portion of said restriction means comprising an extension of said needle body extending axially away from said one end of said needle body and having a stem portion slidable in a bore of said support means and terminating at a free end thereof remote from said strip, said needle body being unrestrained from the stem portion free end to the coupling to said strip movable end, said stem portion free end being movable in a fuel passageway of said fuel duct means to vary said flow controlling cross-section thereof in response to ambient temperature-change-induced movement of the strip free end relative to the strip fixed end.

2. The carburetor set forth in claim 1 wherein the longitudinal central axis of said needle body and the axis of said fuel passageway intersect generally perpendicularly.

3. The carburetor set forth in claim 1 wherein said needle body is externally threaded and said strip movable end includes needle body mounting means having an internally threaded throughbore, said needle body being axially insertable in said mounting bore and adjustably threadably secured therein to vary the position of said stem in said fuel passageway by rotation of said body relative to said mounting bore threads.

4. The carburetor set forth in claim 3 wherein the material and dimensions of said needle body are selected relative to the dimensions of said fuel passageway such that said differential expansion and contraction of said needle body relative to said support means moves said stem free end through a range of movement co-related with the normal ambient range of temperatures in which said carburetor is operable so as to vary the cross-sectional flow area in the order of about 1% per 10° C. ambient temperature change to thereby modulate fuel flow in said passageway, said stem free end movement in response to said differential expansion and contraction of said needle body being algebraically cumulative to flow modulation movement of said needle body caused by movement of the free end of said bi-metal strip.

5. The carburetor set forth in claim 4 wherein said support means is a metallic material and said needle body of said variable restriction means is made from a plastic material.

6. The carburetor set forth in claim 5 wherein said metallic material comprises aluminum or an aluminum alloy and said plastic material comprises Delrin or other plastic material resistant to hydrocarbon fuel adverse effects.

7. The carburetor set forth in claim 1 wherein said fuel duct means of said carburetor comprises main and idle fuel duct means constructed and arranged to separately conduct fuel from said chamber respectively to main and idle fuel nozzles in said mixing passage, said variable flow restriction means being associated with one of said main and idle duct means for varying the effective flow cross-sectional area of said one fuel duct means to modulate the flow rate of fuel therethrough respectively to the associated one of said main and idle fuel nozzles in said mixing passage.

8. The carburetor set forth in claim 7 wherein another one of said variable flow restriction means is associated in like manner with respect to the other one of said main and idle fuel duct means to also modulate the flow rate of fuel to the other one of said fuel nozzles in said mixing passage.

9. The carburetor set forth in claim 8 wherein said needle body of each of said main and idle variable restriction means is externally threaded and said strip movable end includes needle body mounting means having an internally threaded throughbore, said needle body being axially insertable in said mounting bore and adjustably threadably secured therein to vary the position of said stem in said fuel passageway by rotation of said body relative to said mounting bore threads.

10. The carburetor set forth in claim 9 wherein each of the material and dimensions of each said needle body are selected relative to the dimensions of said fuel passageway such that said differential expansion and contraction of said needle body relative to said support means moves said stem free end through a range of movement co-related with the normal ambient range of temperatures in which said carburetor is operable so as to vary the cross-sectional flow area in the order of about 1% per 10° C. ambient temperature change to thereby modulate fuel flow in said passageway, said stem free end movement in response to said differential expansion and contraction of said needle body being algebraically cumulative to flow modulation movement of said needle body caused by movement of the free end of said bi-metal strip.

11. The carburetor set forth in claim 1 including first stop means constructed and arranged relative to the free end of said bi-metal strip such that said strip free end is fixed against temperature-change-induced movement in a given direction when the ambient temperature changes beyond a first predetermined ambient set point temperature tending to move said strip free end in said given direction.

12. The carburetor set forth in claim 11 wherein said stop means is adjustable relative to the path of travel of said strip free end for varying the predetermined set point temperature.

13. The carburetor set forth in claim 11 including second stop means constructed and arranged to also prevent movement of said strip free end in a direction opposite to said given direction at a second predetermined ambient set point temperature such that said strip free end is movable only in response to ambient temperature changes occurring at temperatures between said predetermined set point temperatures.

14. The carburetor set forth in claim 11 wherein said support means comprises a body of said carburetor and said first stop means comprises a bi-metal mounting surface on said carburetor body transversely intersecting said bore at an end opening thereof, said bi-metal strip being mounted to said body mounting surface at said fixed end thereof and being constructed and arranged such that said strip free end spans said bore end opening and lays against said body mounting surface at said first predetermined ambient set point temperature whereby said body bi-metal mounting surface functions as said first stop means.

15. The carburetor set forth in claim 14 wherein said carburetor includes bi-metal enclosure means including a wall spaced a given distance outwardly of said body relative to said body bi-metal mounting surface and enabling travel of said strip free end toward said wall in a direction opposite to said given direction, and including second stop means on said wall for preventing movement of said strip free end in said opposite direction at a second predetermined ambient set point temperature such that said strip free end is movable only in response to ambient temperature changes occurring at temperatures between said predetermined set point temperatures.

16. The carburetor set forth in claim 15 wherein said second stop means comprises a screw plug threadably mounted in said wall and threadably adjustable toward and away from said body face for varying said second predetermined set point of said bi-metal.

17. The carburetor set forth in claim 16 wherein said screw plug has a small diameter through-hole and said needle is threadably adjustably mounted on said strip and has rotational adjustment means facing toward said plug, said plug being aligned with said needle adjustment means to permit insertion of a fine adjustment tool through said plug hole into operative engagement with said needle adjustment means to thereby limit access to said needle via said screw plug.

18. In a carburetor having a mixing passage, a fuel supply chamber, fuel duct means to conduct fuel from the chamber to the mixing passage, and a fuel metering system associated with said fuel duct means including variable restriction means for varying the effective flow cross-sectional area of said fuel duct means to modulate the mass flow rate of fuel to said mixing passage, said variable restriction means comprising support means and fuel metering means defining said flow cross-sectional area and respectively having first and second different linear coefficients of expansion such that differential expansion and contraction of said support and fuel metering means relative to one another in response to fuel temperature changes varies the flow-controlling cross-sectional area of said fuel duct means inversely relative to such temperature changes to thereby modulate temperature-dependent fuel density changes to reduce resultant mass fuel flow rate variations, said fuel metering means being disposed in flow controlling relation with said fuel duct means and having mounting means supported in fixed relation by and to said support means and a valve member, said mounting means being disposed at one end of said valve member and said fuel metering means comprising an extension of said valve member extending longitudinally of said valve member away from said one end of said valve member and terminating in a free end slidable in said support means, said valve member being unrestrained from said free end to one end thereof, said valve member free end having a free edge movable in a fuel passageway of said fuel duct means to define therewith said flow controlling cross-sectional area such that the differential expansion and contraction of said valve member relative to said support means in response to fuel temperature changes causes movement of the free end of said valve member in a direction to effect the variation in flow controlling cross-sectional area of said fuel duct means, said movement of said valve member being in a direction transverse to the direction of fuel flow in said fuel passageway in the zone of said flow controlling cross-sectional area, said free end and free edge being configured relative to said valve member movement direction and to said fuel passageway to create turbulent flow of the fuel flowing past said flow-controlling cross-sectional zone whereby the effect of temperature-induced viscosity changes in said fuel is essentially nullified and essentially only temperature-induced changes in fuel density are compensated by said differential expansion and contraction variation of said flow-controlling cross-sectional area, the improvement in combination therewith wherein said valve member comprises a needle slidable in a bore of said support means and having a stem protruding therefrom defining said free end and edge of said fluid metering means, and also comprises a bi-metal strip fixed at one operative end by said mounting means to said support means and another operative end spaced longitudinally of said strip remote from said one strip end and operably coupled to said needle to generate at least the principal differential expansion and contraction of said flow restriction means relative to said support means to cause the variation of said flow-controlling cross-sectional area.

19. The carburetor set forth in claim 18 wherein said bi-metal strip comprises a laminar body of material having a relatively high internal interlaminar coefficient of differential expansion operable to generate substantially all of the differential expansion and contraction movement of the fluid metering means relative to said support means.

20. The carburetor set forth in claim 18 wherein said needle comprises a rod-like needle body having a cylindrical portion sized for securement in a mounting means of said bi-metal strip, said fuel metering means comprising an extension of said needle body extending axially away from said strip mounting means to said stem portion, said bore intersecting said fuel passageway in said zone with its axis oriented transverse to fuel flow direction in said zone.

21. The carburetor set forth in claim 20 wherein said needle body cylindrical portion is externally threaded and said strip needle mounting means is internally threaded, said needle body being axially insertable in said strip needle mounting means and adjustably threadably secured therein to vary the position of said stem in said fuel passageway by rotation of said body relative to said strip needle mounting means.

22. The carburetor set forth in claim 20 wherein said needle body material and dimensions are selected relative to the dimensions of said fuel passageway such that differential expansion and contractions of said needle body moves the free end of said stem through a range of movement relative to said strip needle mounting means co-related with the normal ambient range of temperatures in which said carburetor is operable so as to vary the cross-sectional flow controlling area in the order of about 1% per 10° C. ambient temperature change to thereby so modulate fuel flow in said passageway inversely in accordance with said temperature-induced changes in the density of the fuel flowing therethrough.

23. The carburetor set forth in claim 20 wherein said fuel duct means of said carburetor comprises main and idle fuel duct means constructed and arranged to separately conduct fuel from said chamber respectively to main and idle fuel nozzles in said mixing passage, said fuel metering system comprising a pair of said variable restriction means associated one with each of said main and idle duct means for varying the effective flow cross-sectional area of said main and idle fuel duct means to so modulate the flow rate of fuel therethrough respectively to said main and idle fuel nozzles in said mixing passage.

24. The carburetor set forth in claim 22 wherein said support means is a metallic material and said needle body of said restriction means is made from a plastic material.

25. The carburetor set forth in claim 24 wherein said metallic material comprises aluminum or an aluminum alloy and said plastic material comprises Delrin or other plastic material resistant to hydrocarbon fuel adverse effects.

26. The carburetor set forth in claim 20 wherein the longitudinal central axis of said needle body and the axis of said fuel passageway are oriented generally perpendicularly to one another.

27. The carburetor set forth in claim 26 wherein said free end edge face of said stem portion is disposed generally flush with the central axis of said fuel passageway in said zone at a selected standard ambient adjustment temperature.

28. The carburetor set forth in claim 27 wherein said fuel passageway comprises a cylindrical bore in said zone having a diameter less than that of said stem portion and said axes of said stem portion and said fuel passageway bore substantially intersect in said zone.

29. A method of controlling the air-to-fuel ratio (A/F) in the operation a carburetor having a body with a liquid fuel metering system associated with liquid fuel duct means in the body including variable flow restriction means for varying the effective flow cross-sectional area of the duct means to modulate the flow rate of liquid fuel into a ambient air and liquid fuel mixing passage of the carburetor body, the variable flow restriction means comprising fixed support means on the body containing the fuel duct means and an operably associated temperature responsive movable fuel metering actuating means including valve means directly immersed in the liquid in the duct means and operably disposed in liquid fuel flow controlling relation with the duct means, the variable flow restriction actuating means also including a temperature responding element having a valve coupling portion operably connected to the valve means and a mounting portion secured in fixed relation to the body support means and spaced remotely from the valve coupling portion of the actuating means element such that differential expansion and contraction of the actuating means element relative to said support means in response to temperature changes in the element causes bodily movement of the valve means in a direction effective to vary the flow-controlling cross-sectional area of the fuel duct means inversely relative to temperature changes in the element, said method comprising the control step of:

(1) mounting the temperature responding element on the carburetor body in a location exposed to ambient exterior air temperature surrounding the carburetor and generally remote from and out of direct contact with the liquid fuel flow in the carburetor body such that the temperature of the element tracks that of ambient atmosphere surrounding the element whereby the element is directly responsive to temperature changes in such surrounding ambient atmosphere, (2) determining a first range of ambient air temperatures in which the carburetor is normally to be operated and establishing within the first range a desired predetermined first ambient air temperature set point value for peak lean out of A/F produced by operation of the carburetor in the first temperature range, (3) positionally setting the valve means and associated element relative to the carburetor body to produce the peak lean out of A/F at this predetermined set point temperature, and (4) structurally preventing the movement of the temperature responding element to thereby prevent bodily movement of the valve means when the temperature of the ambient air surrounding the carburetor is in the first range in which the carburetor is normally operable and varies in such first range above the predetermined first ambient temperature set point whereby in operation of the carburetor the A/F output of the carburetor is made progressively richer both when ambient air temperatures progressively decreases below and progressively increases above the predetermined first set point temperature.

30. The method set forth in claim 29 comprising the further steps of providing the actuating means as a bi-metal member fixedly secured at the mounting portion thereof to the body support means and having another portion movable by such ambient atmosphere temperature-change-induced bi-metal flexing, and operably coupling the bi-metal movable other portion to the valve means to cause the valve means to be movable in the duct means to vary the flow controlling cross-section thereof.

31. The method set forth in claim 30 wherein A/F adjustment of the valve means is provided by threadably interconnecting the valve means with the bi-metal other portion.

32. The method set forth in claim 30 comprising the further steps of providing the valve means in the form of an elongate valve body having a coefficient of expansion substantially greater than that of the material of the carburetor body, connecting said valve body to said bi-metal other portion so as to extend lengthwise therefrom in the direction of movement of the bi-metal other portion such that variations in valve body length with changes in its temperature caused by changes in temperature of the liquid fuel flowing past the valve-body in the fuel duct means also modulates the variation in flow-controlling cross-section thereof.

33. The method set forth in claim 30 wherein step 4 comprises the step of providing first stop means operably connected to the carburetor body for preventing movement of the bi-metal other portion in the given direction it tends to move when the ambient air temperature causes the element temperature to increase above said first set point temperature value.

34. The method set forth in claim 33 including the further step of adjusting the position of the first stop means relative to the path of travel of the bi-metal other portion for varying the adjustment of the valve means for any given desired set point temperature and corresponding peak lean out of the A/F.

35. The method set forth in claim 33 including the further step of providing second stop means operably connected to the carburetor body for preventing movement of the bi-metal other portion in a direction opposite to the given direction at a second desired predetermined temperature set point value lower than said first value. such that the bi-metal other portion is movable only in response to ambient temperature changes occurring at temperatures between the temperature limits of the first and second set point values whereby the carburetor A/F output progressively leans out as ambient temperature decreases below said second set point value.

* * * * *

UNITED STATES PATENT AND TRADEMARK OFFICE

CERTIFICATE OF CORRECTION

PATENT NO. : 5,688,443

DATED : November 18, 1997

INVENTOR(S) : Mark S. Swanson

It is certified that error appears in the above-indentified patent and that said Letters Patent is hereby corrected as shown below:

Title page, item [57],

In the ABSTRACT, Line 11, change "adjustable" to "adjustably".

Col 16, Line 14, after "free" insert "end".

Col 20, Line 15, change "a" to "an".

Signed and Sealed this

Twenty-eighth Day of July, 1998

*Attest:*

*Attesting Officer*

BRUCE LEHMAN

*Commissioner of Patents and Trademarks*